US005924434A

United States Patent [19]

Cato, III

[11] Patent Number: 5,924,434

[45] Date of Patent: Jul. 20, 1999

[54] CRUTCH

[75] Inventor: Wayland H. Cato, III, Gloucester, N.C.

[73] Assignee: Mobility Devices, Inc., Wilmington, N.C.

[21] Appl. No.: 08/867,252

[22] Filed: Jun. 2, 1997

[51] Int. Cl.[6] ..... A61H 3/02

[52] U.S. Cl. ..... 135/68; 135/71; 135/72; 135/76

[58] Field of Search ..... 135/68, 65, 66, 135/70, 71, 75, 76, 73; 297/411.1, 6

[56] References Cited

U.S. PATENT DOCUMENTS

| | | | |
|---|---|---|---|
| 2,388,778 | 11/1945 | Wheeler . | |
| 2,788,793 | 4/1957 | Abbott | 135/68 |
| 2,960,095 | 11/1960 | Smith, Jr. . | |
| 3,157,187 | 11/1964 | Murcott | 135/68 |
| 3,710,807 | 1/1973 | Ferry | 135/68 |
| 3,999,565 | 12/1976 | Delacour et al. | 135/69 X |
| 4,141,375 | 2/1979 | Tykwinski et al. | 135/68 X |
| 4,248,256 | 2/1981 | Thomas | 135/71 X |
| 4,252,137 | 2/1981 | Cohen | 135/75 X |
| 4,748,994 | 6/1988 | Schultz et al. | 135/67 |
| 4,787,405 | 11/1988 | Karwoski . | |
| 5,193,567 | 3/1993 | Razny, Jr. . | |
| 5,201,334 | 4/1993 | Tseng | 135/72 X |
| 5,318,058 | 6/1994 | Zimmerman . | |
| 5,351,702 | 10/1994 | Denjean . | |
| 5,482,070 | 1/1996 | Kelly | 135/68 X |
| 5,495,867 | 3/1996 | Block . | |
| 5,524,658 | 6/1996 | Schrader | 135/72 |
| 5,555,904 | 9/1996 | Stockwell | 135/68 |

FOREIGN PATENT DOCUMENTS

| | | | |
|---|---|---|---|
| 77604 | 8/1919 | Austria | 135/68 |

OTHER PUBLICATIONS

"The Hope Crutch", the Brochure by CareBorne, Inc., 1995.

*Primary Examiner*—Carl D. Friedman
*Assistant Examiner*—Winnie S. Yip
*Attorney, Agent, or Firm*—Rhodes, Coats and Bennett, L.L.P.

[57] ABSTRACT

A crutch including an extendible, locking shaft having an upper end and a lower end; a handgrip positioned to the front of the crutch and joined to the upper end of the shaft by a connecting arm; and an underarm at a level below the level of the handgrip, whereby the user's hand is positioned above the level of the user's underarm when using the crutch, to thereby pull upward on the handgrip during forward movement, instead of a pressing downward on the handgrip and underarm support.

14 Claims, 2 Drawing Sheets

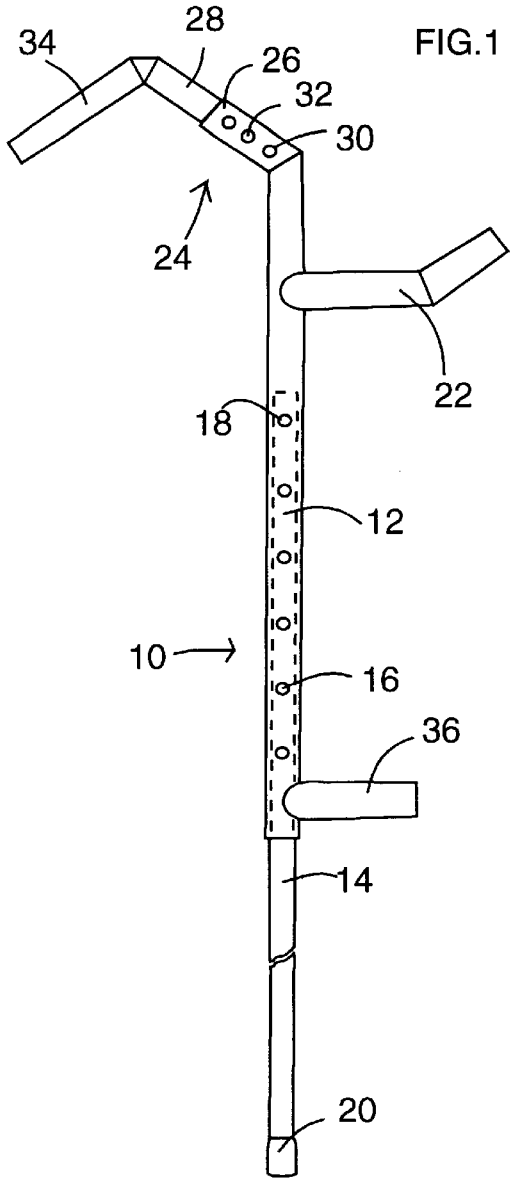
FIG.1
FIG.2
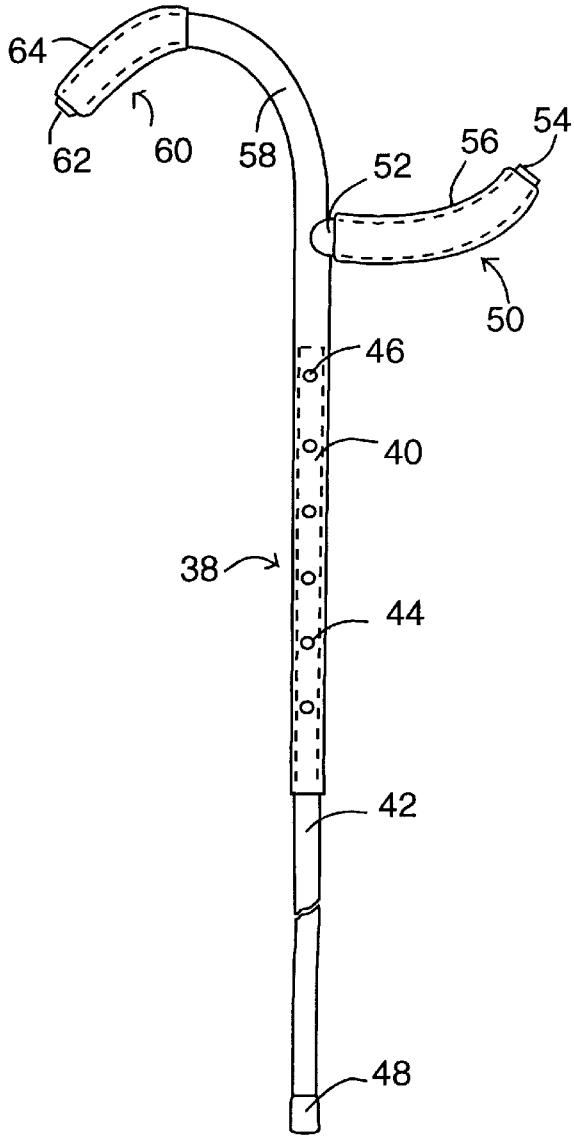

CRUTCH

BACKGROUND OF THE INVENTION (1) Field of the Invention

The present invention relates generally to an improved walking assistance device or crutch, and in particular to a crutch designed so that a large part of the user's weight us supported by the muscles of the upper body, instead of by the arms.

(2) Description of the Prior Art

Conventionally designed crutches are comprised of a generally vertical support shaft, that may be adjustable in length, having a horizontal support surface or underarm support at the top of the shaft for placement beneath the user's arm, a slip resistant tip at the lower end of the shaft for contact with the ground, and a generally horizontal handgrip positioned on the shaft intermediate the upper and lower ends of the shaft. Normally, the distance between the underarm support and the handgrip is slightly less than the length of the user's arm, measured from the user's underarm to the palm of the user's hand.

Crutches of this design are positioned with the underarm support surface positioned beneath, and slightly below, the user's underarm. The user, having his arm in a generally straight, downward direction grips the handgrip with his hand. When used, the tip of the crutch is positioned forward of the user's body, and the user moves his body over the location of the crutch tip, with the weight of his body being carried on the arms only, with contact being between the underarm and the upper support surface, and between the palm and the lower support surface or handgrip.

Numerous variations of this crutch construction have been proposed in the prior art. However, with all of these designs, support of the user necessarily results in pressure on the inner part of the user's underarm, and on the user's palm, which is transmitted as a compression of the user's wrist, elbow and shoulder joints. As a result, use of crutches of this construction, particularly for an extended period, can result in discomfort, and potential long-term injury, to the user's muscles, ligaments, joints and nerves, particularly under the arm.

A crutch that would provide support and mobility to a physically impaired person without this resultant discomfort and potential injury would be of considerable use and value to those persons requiring a crutch.

SUMMARY OF THE INVENTION

The invention is directed to an improved crutch, and in particular a crutch that provides support without discomfort and injury to the user resulting from pressure on the arm joints and underarm ligaments and nerves, and in particular to a crutch in which the user's weight is supported by lifting with the user's upper body muscles. Generally, this desirable result is achieved with a crutch comprised of a shaft, a handgrip attached to the shaft, and an underarm support attached to the shaft below the handgrip.

More specifically, the crutch of the present invention is comprised of a generally vertical shaft, a generally horizontal support arm positioned on the shaft at a level slightly beneath the user's underarm, and a handgrip positioned on the shaft above the underarm support where the handgrip can be easily grasped by the user's hand. Preferably, the handgrip projects outwardly from the front of the shaft when the crutch is positioned for use, with the underarm support projecting outwardly from the rear of the shaft, so that the underarm support is generally opposite from the handgrip, or directly over the shaft.

When used, the underarm support is simply placed beneath the user's arm. The user reaches up to a level of about shoulder height to grasp the handgrip, which projects forward from the crutch. The tip of the crutch is moved forward by the user pointing his elbow in a forward direction. The user then swings forward over the tip of the crutch, while pulling down on the handgrip, lifting the user's body weight upward and away from the underarm support. Thus, the user's weight is supported on the user's arm and upper body muscles, without compression of the arm joints, ligaments or nerves.

A crutch of the present construction is especially suitable for use by athletes, and others who are in good physical condition, but with injuries to the lower extremities that impair their mobility. Such persons normally have excellent upper body strength that can be used to support their body weight. This strength is not used with conventional crutch designs. Moreover, the pressure on joints, ligaments and nerves, even if only causing slight injury or swelling, can be of substantial damage to an athlete, who requires the peak of joint and ligament condition in athletic performance.

Looking at the construction of the crutch in more detail, the shaft, while it may be of one piece, is desirably of a telescoping construction, so that its length can be adjusted to accommodate users of different heights. The length of the shaft can thus be adjusted to correctly position the underarm support beneath the user's arm. For example, the shaft can be formed of a first tubular section of a given outer diameter, e.g., 1–1.5 inches, and a second tubular section with an outer diameter equal to, or slightly less than, the inner diameter of the first section, slidably positioned inside the first section. A part of the inner section can then be extended from inside the outer section, so that the combined lengths of the outer section and the exposed part of the inner section raise the underarm support to the desired height.

A locking means will be used to hold the inner section at the desired extension. A locking means that is commonly used to lock crutch shafts is comprised of a plurality of axially spaced holes in the outer tubular section, and a spring loaded locking button extending outwardly from the inner tubular section, preferably from near the upper end of the section, so that it can project into a selected hole positioned over the button. The tubular section are preferably formed of a metal, such as aluminum, although other materials, e.g., plastic, carbon fiber, or titanium, can be used. Other locking means, such as frictional locks of the kind known in the relevant art, can also be used for this purpose.

The underarm support, which may be formed of the same material as the shaft sections, will be generally horizontal, but may be curved upwardly at its outer end or ends to improve the fit of the support under the arm. Attachment of the underarm support to the shaft may be at one end of the support, or at a central part of the support.

In one alternative, the underarm section has an inner end joined to the shaft, and an outer end. The outer end of the support, if tubular, may be capped with an end cap to prevent debris from entering the tube, and for aesthetic purposes. A pad or covering, e.g., a tubular foam covering, may be placed over the part of the support that will engage the user's underarm for improved comfort.

The inner end of the underarm support may be connected to the shaft by welding, or by the use of a fastening means, such as a threaded bolt extending generally horizontally through the shaft and into a connector in the end of the inner end of the underarm support. Alternatively, the underarm support may be integrally molded with the section of the shaft where it is joined. For example, the shaft section adjacent the underarm support can be separately formed, with the remainder of the shaft being attached to the lower part of this section, e.g., by a threaded or frictional connection.

In another alternative, the underarm support is attached at its center, e.g., by welding or a bolt, to the top of the shaft, so that the shaft will be generally vertically positioned beneath the user's underarm during use. The handgrip can then be attached to a connecting arm that is attached to the underarm support, or to the shaft.

The handgrip portion of the crutch is positioned at a level above the level of the underarm support when the crutch is in an upright position. Preferably, the position of the handgrip is such that the user's elbow will be generally beneath the user's underarm when gripping the handgrip. In this manner, the crutch will be of a compact configuration, and there will be minimal strain on the user's hands, arms or shoulders, since the arms will be held in a relaxed position.

The handgrip is preferably positioned as an angle, so that it can be gripped without twisting of the wrist and placing the muscles of the forearm under stress. For this reason, the handgrip will normally be inclined downwardly from its attached end to its distal end at an angle of about 20–45°, preferably about 30°, below horizontal. The handgrip is generally of a length and diameter sized to accommodate the user's hand. For example, the handgrip may be a metal tube having a length of from about 3 to about 6 inches, and a diameter of from about 0.75 to about 1.5 inches. A resilient covering may be positioned over the tube to improve comfort and grip. The grip may be further improved by forming finger molds in the covering. Alternatively, the handgrip may be formed of molded plastic or rubber, in which case the molded handgrip can have finger grips molded into its construction.

The handgrip is joined to the shaft by a connecting arm that may be formed as a separate part of the crutch, or may be formed by bending the top end of the crutch shaft in a forward direction. The handgrip can be formed by bending the end of the connecting arm downwardly to the desired angle. Thus, while the handgrip, connecting arm and crutch shaft are described as separate elements for purposes of describing the crutch, it is to be appreciated that these elements can be integrally formed from a single piece of tubing by bending the tubing to the desired shape.

However, these three sections can be formed in other ways. For example, the handgrip can be comprised of an elongated section to accommodate the user's hand, with an outer end and an inner end. The connecting arm can be comprised of an elongated center section having an outer end connected to the inner end of the handgrip, and an inner end connected to the shaft, e.g., at the upper end of the shaft.

In order to adjust the position of the handgrip to accommodate users with arms of different lengths, the connecting arm can be of a telescoping construction. For example, the connecting arm can be comprised of an outer tube having an inner end connected to the shaft, and inner tube nested within the outer tube, and having an outer end connected to the upper end of the handgrip. Similarly, the length of the shaft between the underarm support and the connecting arm can be of a telescoping construction so that the height of the handgrip relative to the height of the underarm support can be adjusted. The connection of the connecting arm to the upper part of the shaft can also be a swivel connection that can be locked with the connecting arm projecting from the opposite side of the crutch from the underarm support for use, or over the underarm support for storage.

In addition to the handgrip positioned above the underarm support, the crutch may include an additional handgrip attached to the crutch shaft beneath the underarm support at approximately the length of the user's arm. The availability of this auxiliary handgrip gives the user a choice of handgrips, allowing the user to alternate between the handgrip positions.

Accordingly, one aspect of the present invention is to provide a crutch comprised of a generally vertical, extendible shaft; a handgrip positioned at a given level on the front side of the crutch; a connecting arm joining the handgrip to the upper end of the shaft; and an underarm support at a level below the level of the handgrip.

Another aspect of the present invention is to provide a crutch comprised of an extendible, locking shaft having an upper end and a lower end; a handgrip positioned to the front of the crutch, the handgrip including an elongated hand engaging section having an outer end and an inner end, the outer end being positioned at a level below the inner end at an angle of about 20° to about 45° below horizontal; a connecting arm joining the handgrip to the shaft, the connecting arm including an outer end joined to the inner end of the handgrip, and an inner end joined to the upper end of the shaft; and a generally horizontal underarm support attached to the shaft at a level below the level of the handgrip when the crutch is in an upright position.

It is yet another aspect of the invention to provide a crutch comprised of a molded body engaging member having a handgrip and an underarm support, the handgrip and underarm support extending outwardly from opposite sides of the member, with the underarm support being positioned below the handgrip, whereby a user's hand is raised to above the level of the user's underarm to grasp the handgrip, a shaft receiving recess in the lower surface of the member; and an extendible shaft having an upper end insertable into the shaft receiving recess. The molded member may include finger receiving indentations on its upper surface; a central body portion and a connecting arm extending from the body portion to the handgrip. The underarm support may have an inner end integral with the body portion beneath the connecting arm.

These and other aspects of the present invention will become apparent to those skilled in the art after a reading of the following description of the preferred embodiment.

BRIEF DESCRIPTION OF THE DRAWINGS

FIG. 1 is a side view of an embodiment of the invention in which the handgrip and connecting arm are formed of separate pieces that are welded together.

FIG. 2 is a side view of another embodiment of the invention in which the handgrip and connecting arm are formed integrally with the shaft by bending the upper end of the shaft.

DETAILED DESCRIPTION OF THE INVENTION

Figure 3:
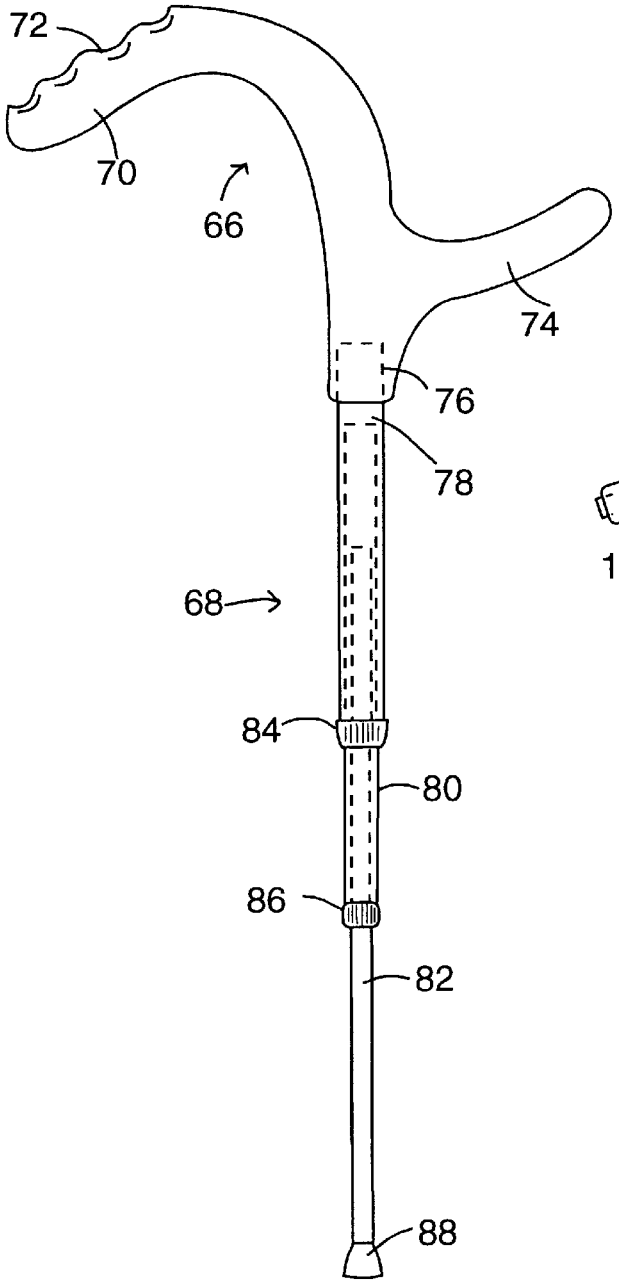
FIG. 3 is a side view of another embodiment of the invention in which the handgrip, the connecting arm and the underarm support are molded as a single unit, and attached to the upper end of the shaft.

In the following description, terms such as horizontal, upright, vertical, above, below, beneath, and the like, are used solely for the purpose of clarity in illustrating the invention, and should not be taken as words of limitation. It should also be understood that the drawings are for the purposes of illustration, and are not intended to be to scale.

FIG. 1 illustrates an embodiment of the invention formed from welded segments. In this embodiment, the crutch is comprised of a telescoping support shaft, generally 10, formed of a tubular outer section 12 and a tubular inner section 14 slidably positioned inside section 12. Section 12 includes a plurality of evenly spaced, axially aligned holes 16 positioned to receive a spring loaded locking button 18 attached to the upper end of shaft section 14, to lock the sections in the desired relationship. A resilient, rubber tip 20 is fitted over the lower end of section 14.

An underarm support, generally 22, extends horizontally from near the upper end of shaft 10. Support 22 is comprised of an aluminum tubular member having an inner end welded to tubular section 12, and an upturned outer end. An end cap may be fitted into the outer end of support 22, and a resilient sleeve may be place around support 22 for added comfort.

A connecting arm, generally 24, extends upwardly and outwardly from the upper end of shaft 10 in the opposite direction from support 22. Connecting arm 24 is comprised of an outer tubular section 26 having an inner end welded to the upper end of shaft 10, and a telescoping inner section 28, slidably positioned within section 26. Section 26 includes a plurality of evenly spaced, axially aligned holes 30, positioned to received a spring loaded locking button 32 attached to section 28, to lock the sections in the desired position.

The outer end of section 28 is welded to the inner end of handgrip 34, which is inclined downwardly from its attached end to its outer end at an angle of 30° below horizontal. The level of the inner end of handgrip 34 relative to underarm support 22 may be adjusted by adjusting the length of connecting arm 24. Handgrip 34 can also be fitted with a cap at its distal end and a foam rubber tubular cover.

The crutch illustrated in FIG. 1 also includes a generally horizontal auxiliary handgrip 36 having an inner end attached to outer shaft section 12, and extending to the rear of the crutch beneath support 22. The inner end of auxiliary handgrip 36 may be welded to shaft section 12 or attached by other means.

FIG. 2 illustrates an alternative embodiment of a crutch having a telescoping support shaft 38, formed of a tubular outer section 40 and a tubular inner section 42, shown in its completely nested position for ease of illustration, slidably positioned inside section 40. Section 40 includes a plurality of evenly spaced, axially aligned holes 44 positioned to receive a spring loaded locking button 46 attached to the upper end of tubular section 42, so that the two tubular sections can be locked in the desired telescoped relationship. A resilient, rubber tip 48 is fitted over the lower end of section 42 to improve frictional contact with the ground or other surface.

An underarm support, generally 50, extends horizontally from near the upper end of shaft 40. Support 50 is comprised of an aluminum tubular member 52 having its inner end welded to tubular section 40. An end cap 54 is fitted into the outer end of member 52. In order to increase the user's comfort, member 52 is surrounded by a foam rubber sleeve 56, extending generally the length of member 52.

A connecting arm 58 extends upwardly and outwardly from the upper end of shaft 38 in the opposite direction from support 50. The distal end of arm 58 terminates in handgrip 60, which is inclined downwardly at an angle of 30° below horizontal. The inner end of handgrip 60 is approximately 8 inches above underarm support 50. Connecting arm 58 and handgrip 60 are integrally formed with shaft 38, by curving the upper end of shaft section 40. Handgrip 34 has a cap 62 fitted in its distal end, and a foam rubber tubular covering 64.

FIG. 3 illustrates another embodiment of the invention is which the crutch is comprised of a molded body engaging member, generally 66, and a telescoping shaft, generally 68. Molded member 66 includes a handgrip 70 with a plurality of finger recesses 72 extending toward the front of the crutch, and an underarm support 74 extending outwardly toward the rear of the crutch at a level below handgrip 70.

Molded member 66 may be molded of various materials, including plastic or rubber. Preferably, member 66 has a resilient exterior. As will be well understood to one skilled in the art, member 66 may be formed of a single material, or by molding a resilient material about a rigid skeleton.

Molded member 66 also includes a shaft receiving recess 76 in its lower surface to receive the upper end of shaft 68, which is a telescoping shaft having three sections. Specifically, shaft 68 is comprised of an outer tubular section 78; an intermediate tubular section 80, slidable within section 78; and an inner tubular section 82, slidable within section 80. Instead of the locking mechanism used in earlier examples, knurled friction locks 84 and 86 are used to lock the sections at the desired position. The lower end of section 82 is capped with a rubber tip 88.

Figure 4:
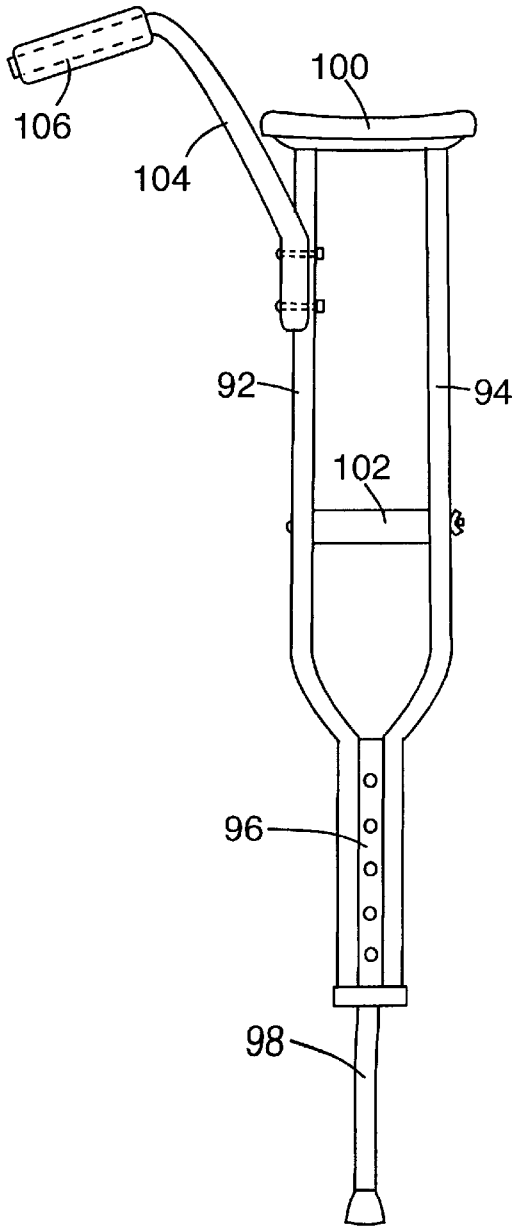
FIG. 4 is a side view of another embodiment of the invention in which an upper handgrip is added to a conventional crutch.

FIG. 4 illustrates a modification of a conventional crutch having parallel vertical members 92 and 94, an outer telescoping section 96, and an inner telescoping section 98. A horizontal, padded underarm support 100 extends between the upper ends of members 92 and 94, and above telescoping shaft section 96. A horizontal, padded auxiliary handgrip 102 extends between members 92 and 94 beneath underarm support 98. Connecting arm 104 extends upwardly and outwardly from shaft 90. The outer end of arm 104 is joined to the inner end of handgrip 106 that extends downwardly at an angle. Handgrip 106 lies in a horizontal plane above the horizontal plane of underarm support 98.

Certain modifications and improvements will occur to those skilled in the art upon a reading of the foregoing description. Also, elements of any of the embodiments shown can be incorporated into other embodiments. It should be understood that all such modifications and improvements have been deleted herein for the sake of conciseness and readability but are properly within the scope of the follow claims.

What is claimed is:

1. A crutch comprised of:

a) a shaft having an upper end and a lower end;

b) a first handgrip positioned to the front of the shaft, said first handgrip having an outer end and an inner end, the outer end being positioned at a level below the inner end, said first handgrip being inclined downwardly from its inner end to its outer end at an angle of from about 20° to about 45° below horizontal;

c) a connecting arm having an outer end joined to said first handgrip, and an inner end joined to said shaft; and d) an underarm support attached to the rear of said shaft at a horizontal level below the outer end of said handgrip, whereby a user's hand is raised to a horizontal level above the horizontal level of the user's underarm to grasp the handgrip when said underarm support is positioned beneath the user's arm.

2. The crutch of claim 1, wherein said shaft is a telescoping shaft having a locking means.

3. The crutch of claim 1, wherein said connecting arm is a telescoping arm having a locking means.

4. The crutch of claim 1, further including a second handgrip attached to said shaft between said underarm support and said shaft lower end.

5. The crutch of claim 1, wherein said second handgrip is positioned beneath said underarm support.

6. A crutch comprised of:

a) a shaft having an upper end and a lower end;

b) a first handgrip positioned to the front of the shaft, said first handgrip having an outer end and an inner end, the outer end being positioned at a level below the inner end, said first handgrip being inclined downwardly from its inner end to its outer end at an angle of from about 20° to about 45° below horizontal;

c) a connecting arm joining the handgrip to the shaft, said connecting arm including an outer end joined to the inner end of said first handgrip, and an inner end joined to the upper end of said shaft; and d) an underarm support attached to the shaft between said shaft upper and lower ends, said underarm support having an inner end joined to the shaft below the joinder of the connecting arm and the shaft, said handgrip and underarm support extending outwardly from opposite sides of said shaft, with the underarm support being positioned at a horizontal level below the handgrip, whereby a user's hand is raised to a horizontal level above the horizontal level of the user's underarm to grasp the handgrip when said underarm support is positioned beneath the user's arm.

7. The crutch of claim 6, wherein said shaft is a telescoping shaft having a locking means.

8. The crutch of claim 6, wherein said connecting arm is a telescoping arm having a locking means.

9. The crutch of claim 6, further including a second handgrip attached to said shaft between said underarm support and said shaft lower end.

10. A crutch comprised of:

a) a extendible shaft having telescoping, locking tubular sections, said shaft having an upper end and a lower end;

b) a first handgrip positioned to the front of the shaft, said first handgrip having an outer end and an inner end, the outer end being positioned at a level below the inner end, said handgrip being inclined downwardly from its inner end to its outer end at an angle of from about 20° to about 45° below horizontal;

c) a connecting arm joining the handgrip to the shaft, the connecting arm including an outer end joined to the inner end of the handgrip, and an inner end joined to the upper end of the shaft;

d) an underarm support attached to the shaft between said shaft upper and lower ends, said underarm support having an inner end joined to the shaft below the joinder of the connecting arm and the shaft, said handgrip and underarm support extending outwardly from opposite sides of said shaft, with the underarm support being positioned at a horizontal level below the handgrip, whereby a user's hand is raised to a horizontal level above the horizontal level of the user's underarm to grasp the handgrip when said underarm support is positioned beneath the user's arm; and e) a second handgrip attached to said shaft between said underarm support and said shaft lower end.

11. The crutch of claim 10, wherein said connecting arm is a telescoping arm having a locking means.

12. The crutch of claim 10, wherein said second handgrip is positioned beneath said underarm support.

13. The crutch of claim 10, wherein said handgrip has a length of from about 3 to about 6 inches, and a diameter of from about 0.75 to about 1.5 inches.

14. The crutch of claim 10, wherein said first handgrip is covered with a resilient covering.

* * * * *